United States Patent [19]

Bracher

[11] 4,171,713

[45] Oct. 23, 1979

[54] ABUTMENT MECHANISM FOR A MOVEABLE DRIVE MEMBER OF A WEAVING MACHINE

[75] Inventor: Hans Bracher, Burgdorf, Switzerland

[73] Assignee: Sulzer Brothers Limited, Winterthur, Switzerland

[21] Appl. No.: 898,017

[22] Filed: Apr. 20, 1978

[30] Foreign Application Priority Data

Apr. 22, 1977 [CH] Switzerland ..... 5020/77

[51] Int. Cl.[2] ..... D03D 49/40

[52] U.S. Cl. ..... 139/167

[58] Field of Search ..... 139/144, 161 R, 161 F, 139/167, 168, 169, 453, 142; 267/34

[56] References Cited

U.S. PATENT DOCUMENTS

| | | | |
|---|---|---|---|
| 330,191 | 11/1885 | Anderson | 139/161 F |
| 503,470 | 8/1893 | Emery | 139/167 |
| 2,013,505 | 9/1935 | Rossmann | 139/142 |
| 2,181,386 | 11/1939 | Vanore | 139/167 |
| 2,371,562 | 3/1945 | Vanore | 139/167 |
| 3,482,828 | 12/1969 | Niada | 139/161 |

*Primary Examiner*—Henry Jaudon

*Attorney, Agent, or Firm*—Kenyon & Kenyon

[57] ABSTRACT

The abutment mechanism provides a resilient damping stop to dampen the initial stopping motion of a moveable drive member of a weft thread return mechanism or weft thread mixer changer as well as a rigid stop to stop movement of the drive member. The mechanism employs a spring biased bolt as an initial stop member. The housing for the bolt can be used as the final stop member or a rigid stop can be positioned within the housing to arrest motion of the bolt. A pin laterally offset from the bolt can also be used as the rigid stop.

10 Claims, 5 Drawing Figures

ABUTMENT MECHANISM FOR A MOVEABLE DRIVE MEMBER OF A WEAVING MACHINE

This invention relates to an abutment mechanism for a moveable drive member of a weaving machine.

As is known, various types of vibrations can occur during the operation of a weaving machine. In many cases, these vibrations occur because of the operation of moveable drive members in the weaving machines, particularly when the drive members are moved intermittently or abruptly. Such vibrations, however, can have an adverse effect on the operation of the weaving machines. For example, in the case of a weft thread return mechanism of a gripper projectile weaving machine, wherein a weft thread is transferred from a two-armed return clip of a return mechanism to a gripper projectile, the vibrations can disturb the thread transfer.

Generally, weaving machines employ a fixed stop to arrest the motion of a weft return lever on the bobbin side. However, a vibration occurs when the lever rebounds on the stop. A corresponding vibration is also produced as a result in the two arms of the weft thread return clip. Since the movements of the bottom arm of the return clip are usually limited by a stop surface while the top arm is free to vibrate, it has been possible for a gap of a size of about 0.1 millimeters to form periodically between the clip surfaces. Consequently, very fine threads may drop out of the clip.

Vibrations may also occur in a weft thread mixer changer mechanism in which use is made of conventional rigid stops for stopping an oscillating shaft. Such vibrations may be relatively intense and may also cause objectionable noise.

Accordingly, it is an object of the invention to reduce vibration in a weaving machine.

It is another object of the invention to reduce vibrations in a weaving machine due to the stoppage of moveable drive members.

It is another object of the invention to provide a simple abutment mechanism which can be employed in weaving machines to arrest the motion of a moveable drive member.

Briefly, the invention provides an abutment mechanism which can be utilized in a weaving machine having a main drive and a sub-assembly including a moveable member which is driven off the main drive and which is disposed to move in a predetermined path. The abutment mechanism includes a resilient damping stop which is disposed in the path of the moveable member to initially dampen movement of the member in the path as well as a fixably mounted rigid stop in the path of the moveable member to stop movement of the member.

In one embodiment, the abutment mechanism has a fixedly mounted housing in which a spring-biased bolt is slidably guided to project from the housing and act as the resilient damping stop while the rigid stop is formed by a part of the housing. To this end, the rigid stop may be annular in form and may constitute an end of the housing or may be disposed within the housing in facing relation to the bolt.

In another embodiment, the rigid stop can be laterally offset from the resilient damping stop.

The abutment mechanism may also have an external thread on the housing for threading of the housing into place on a frame of the sub-assembly as well as a sleeve threadably mounted about the housing for fixing the housing in place in the frame. In addition, the bolt is provided with a shoulder which is disposed in a counterbore of the housing so as to limit outward movement of the bolt while a spring is disposed in the counterbore in abutment with the shoulder to bias the bolt out of the bore. A stud is also secured in the housing in abutment with the spring on a side opposite the shoulder.

When the abutment mechanism is used with a weft thread return mechanism employing a moveable lever to move a weft thread return clip, vibrations in the lever and, hence, in the weft thread return clip, can be damped to such an extent that the weft thread is securely held and cannot drop out. When used with a mixer changer mechanism, there is a considerable reduction in vibration and noise.

These and other objects and advantages of the invention will become more apparent from the following detailed description taken in conjunction with the accompanying drawings in which.

Figure 1:
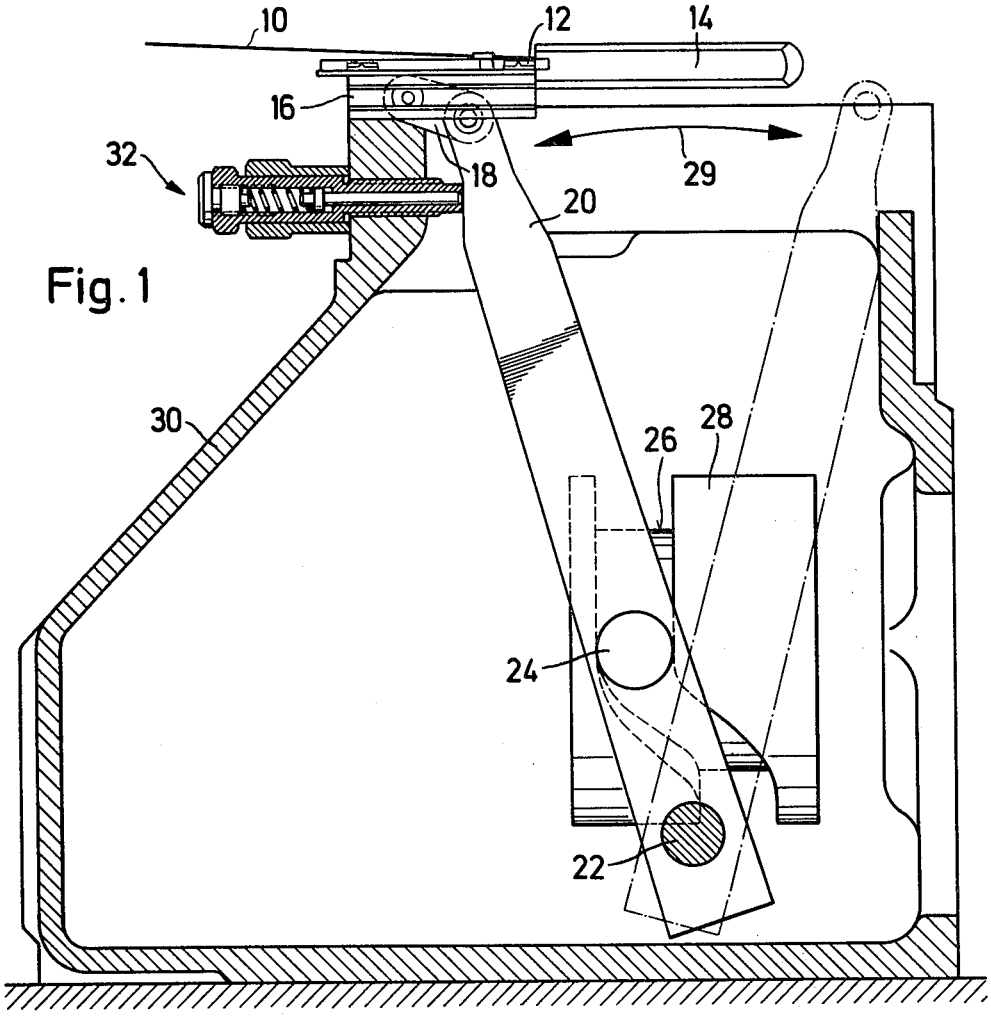
FIG. 1 illustrates a cross-sectional view of a weft thread return mechanism of a gripper projectile weaving machine employing an abutment mechanism in accordance with the invention.

Referring to FIG. 1, a weaving machine which is shown in part by a frame 30 is of known construction and includes a main drive (not shown) and sub-assembly, for example a weft thread return mechanism.

The weft thread return mechanism includes a weft thread return clip 12 which receives a weft thread 10 and which is fixed on a slider 16 to reciprocate back and forth on a frame of the sub-assembly. The slider 16 is connected via a link 18 to a moveable member such as a pivotally mounted lever 20. As shown, the lever 20 is mounted on a fixed pivot 22 within the frame 30 and has a stud 24 which is slidably guided in a cam groove 26 of a rotatable drum 28. The drum 28 is driven off the main drive (not shown) of the weaving machine so as to reciprocate the lever 20 in a predetermined path to effect a picking movement in the direction indicated by the arrow 29. As shown, the drum 28, cam groove 26 and stud 24 form a transmission means to inpart a controlled limited movement to the lever 20. In addition, a gripper projectile 14 is disposed adjacent to the return clip 12 to receive the thread 10 for picking in known fashion.

Figure 2:
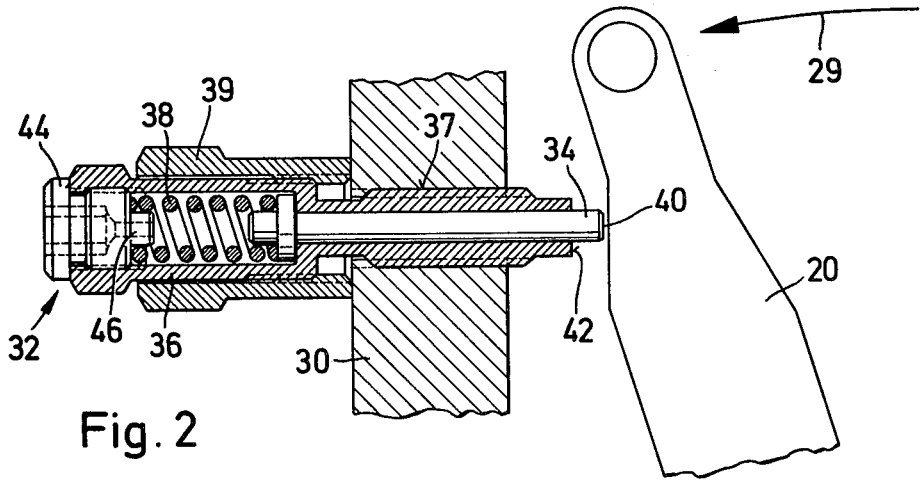
FIG. 2 illustrates an enlarged scale view of a moveable lever of the return mechanism and the abutment mechanism of FIG. 1.

Referring to FIG. 2, an abutment mechanism 32 is adjustably mounted in the frame 30 to arrest the return motion of the lever 20 in a damped manner. This abutment mechanism 32 includes a substantially tubular housing 36 which is threaded via an external thread 37 into the frame 30 and a bolt 34 which is mounted in the housing 36 in spring biased fashion. To this end, the housing 36 is provided with a bore at one end within which the bolt 34 is slideably mounted and a larger counterbore at the other end. The bolt 34 which is sized to project from the end of the housing 36 to provide a stop surface 40 for purposes as described below, has a shoulder disposed within the counterbore to act as a stop to prevent outward movement of the bolt 34. Also, as shown, a spring 38 is disposed within the counterbore in abutment with the shoulder to bias the bolt 34 out of the bore, i.e. to the right as viewed.

The abutment mechanism 32 also has a stud 44 secured, as by a thread, in the housing 36 in abutment with the spring 38 on a side opposite the shoulder of the bolt 34. A sleeve 39 is also threaded on the housing 36 about the counterbore portion.

The bolt 34 of the abutment mechanism is thus resiliently guided in the housing 36 while the external screw threads 37 and sleeve 39 are used to fix the abutment mechanism 32 in the frame 30.

During operation, when the lever 20 first makes contact with the bolt stop surface 40 of the abutment mechanism 32 on a return stroke, the bolt 34 which is disposed in the path of the lever 20 is pressed into the housing 36 against the force of the spring 38. The bolt 34 and spring 38 thus act as a resilient damping stop or shock absorber to initially dampen movement of the lever 20. After the bolt 34 has passed into the housing 36, the end of the housing 36 provides a stop surface 42 of annular form which acts as a fixedly mounted rigid stop to stop any further movement of the lever 20.

Figure 3:
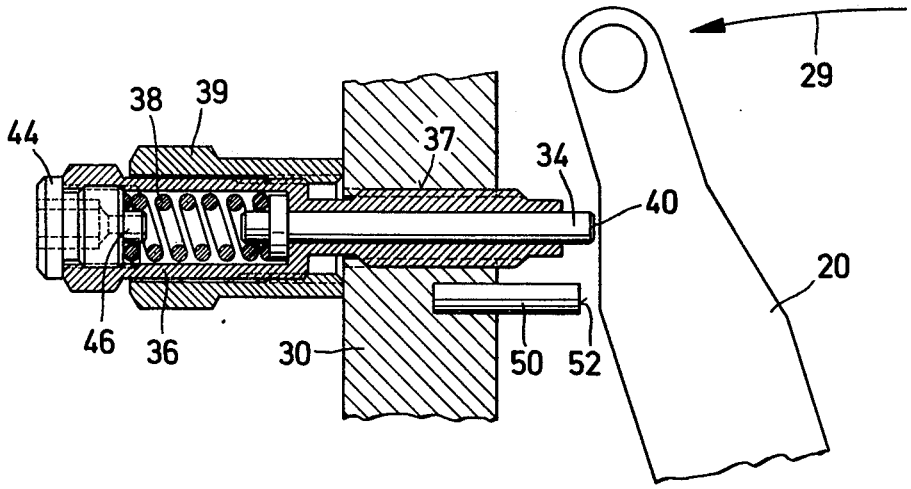
FIG. 3 illustrates a modified stop arrangement in accordance with the invention.

Referring to FIG. 3, wherein like reference characters indicate like parts as above, the abutment assembly may utilize a fixed rigid stop 50 which is laterally offset from the resilient damping stop provided by the spring biased bolt 34. In this regard, the rigid stop 50 is in the form of a pin which has a stop surface 52 in the path of the lever 20. In this case, the spring biased bolt 34 projects out of the housing 36 a sufficient extent such that the lever 20 will abut the stop surface 52 of the pin 50 prior to the complete passage of the bolt 34 into the housing 36.

The construction illustrated in FIG. 3 is advantageous in cases where an independent adjustment of the resilient damping stop surface 40 is desirable. Adjustment of the screw thread 37 and, hence, the bolt 34, thus has no effect on the position of the stop surface 52 on the pin 50. The lever 20 comes into contact successively with the stop surface 40 of the bolt 34 and then the stop surface 52 of the pin 50.

Figure 4:
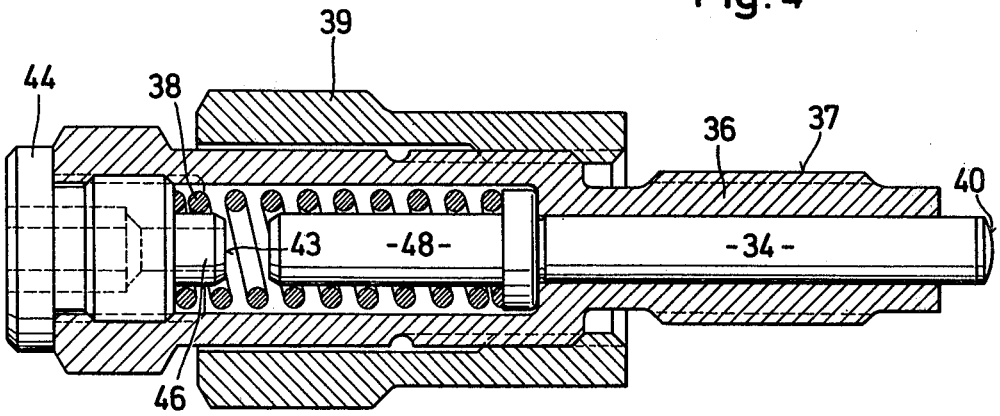
FIG. 4 illustrates a further modified abutment mechanism in accordance with the invention.

Referring to FIG. 4, the abutment mechanism 32 may alternatively be constructed with a stop 46 on the stud 44. In this case, the stop 46 is in the form of a projecting stub on the stud 44 and has a stop surface 43 facing an elongated end 48 of the bolt 34. During operation, when the elongated end 48 of the bolt 34 strikes the stop surface 43 of the stop 46, the lever (not shown) will come to a complete stop. In this regard, the stop surface 40 of the bolt 34 remains outside the housing 36.

Figure 5:
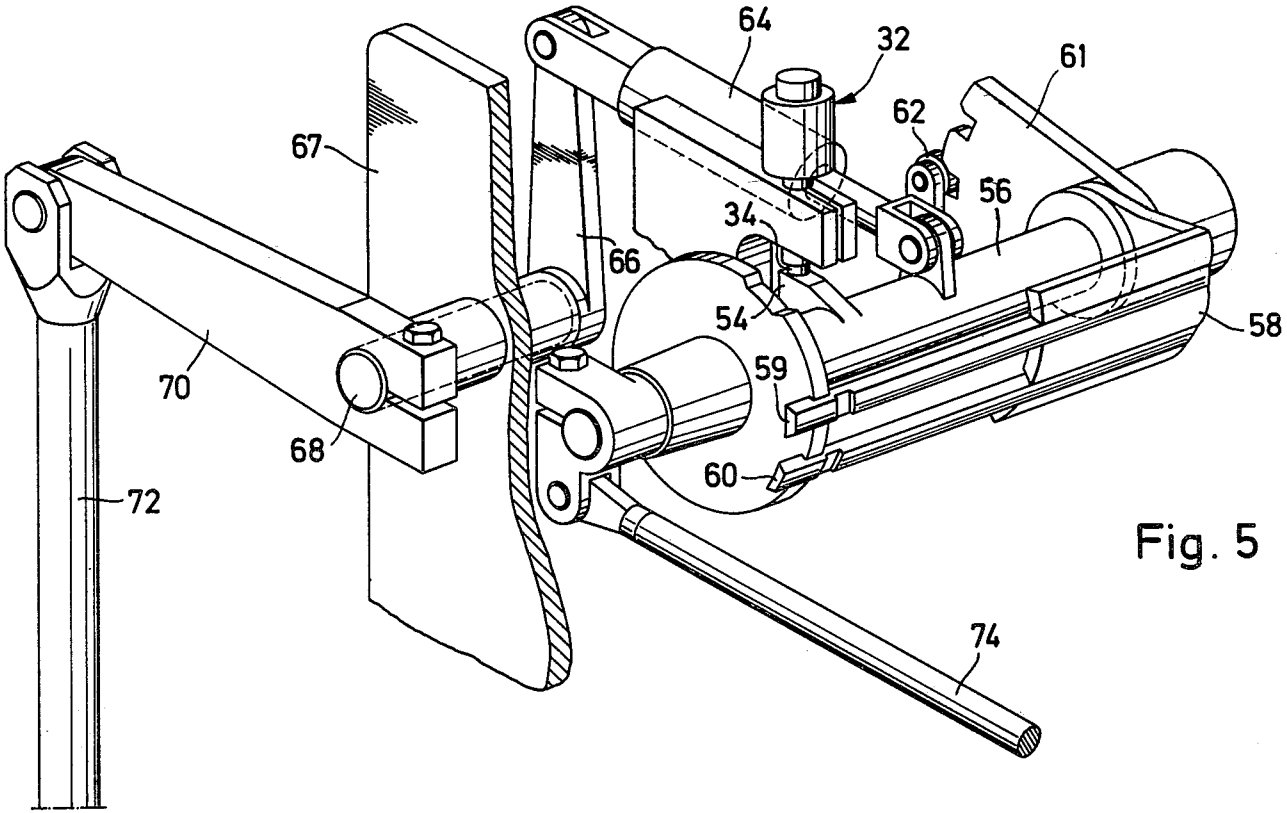
FIG. 5 illustrates a perspective view of a twin weft thread mixer changer mechanism employing an abutment mechanism in accordance with the invention.

Referring to FIG. 5, the abutment mechanism 32 may also be utilized with a twin weft thread mixer changer. As shown, the changer which is of conventional structure has a shaft 56 which carries a twin weft changer 58 with weft thread return devices 59, 60 as well as a stop mechanism 61 having a stop roller 62. The shaft 56 is moved by a spring element 64 which is connected to a control rod 72 of a card dobby (not shown) via a drive lever 66, a shaft 68 mounted in a housing 67 and a drive lever 70. A control linkage 74 for weft thread tensioning devices and brakes is also driven off the shaft 56. The spring element 64 is used to store the drive movement from the card dobby (not shown) until the correct changing time and absorbs the change movement. The purpose of the stop mechanism 61 is to transmit the stored force of the spring element 64 to the twin weft changer 58 by means of the shaft 56 at the correct time.

The shaft 56 is also provided with a cam 54 in order to strike against a spring biased bolt 34 of an abutment mechanism 32 constructed in a manner as described above. This abutment mechanism 32 is fixedly mounted in suitable fashion in the housing of the mixer 58 and serves to limit movement of the changer 58 in one direction. A second cam corresponding to the cam 54 and having an associated abutment mechanism (not shown) also serves to limit the movement of the changer in the other direction.

What is claimed is:

1. In a weaving machine having a frame, a main drive, a sub-assembly including a movable member for driving off said main drive and a transmission means for imparting a controlled limited movement from said main drive to said movable member to move said member in a predetermined path; a tubular housing, a sleeve mounted on and about said housing to fix said housing to said frame, a resilient damping stop disposed in said path, said stop including a spring biased bolt slidably guided in and projecting from said housing member to initially dampen movement of said member in said path and a fixedly mounted rigid stop disposed in said path to stop movement to said member.

2. The combination as set forth in claim 1 wherein said rigid stop is a part of said housing.

3. The combination as set forth in claim 2 wherein said rigid stop is annular in form and constitutes one end of said housing.

4. The combination as set forth in claim 2 wherein said rigid stop is disposed inside said housing in facing relation to said bolt.

5. The combination as set forth in claim 1 wherein said rigid stop is laterally offset from said resilient damping stop.

6. An abutment mechanism for a movable drive member of a weaving machine, said mechanism comprising

- a tubular housing having a bore and a counterbore extending therethrough in coaxial relation;
- a sleeve threadably mounted about and on said housing;
- a bolt slidably mounted in and projecting from said bore, said bolt having a shoulder disposed in said counterbore;
- a spring in said counterbore in abutment with said shoulder to bias said bolt out of said bore; and
- a stud secured in said housing in abutment with said spring on a side opposite said shoulder.

7. An abutment mechanism as set forth in claim 6 wherein said housing has an external thread concentric to said bore.

8. An abutment mechanism as set forth in claim 6 wherein said bolt is movable into said housing under the force of the moveable member to an extent sufficient to permit the member to abut an end of said housing.

9. An abutment mechanism as set forth in claim 6 wherein said stud has a stop facing said bolt to abut said bolt upon movement of said bolt into said housing towards said stop.

10. An abutment mechanism as set forth in claim 6 wherein said stud is threadably mounted in said housing.

* * * * *

UNITED STATES PATENT AND TRADEMARK OFFICE

CERTIFICATE OF CORRECTION

PATENT NO. : 4,171,713

DATED : October 23, 1979

INVENTOR(S) : HANS BRACHER

It is certified that error appears in the above–identified patent and that said Letters Patent are hereby corrected as shown below:

Column 3, line 39, change second occurrence of "on" to --of--

Column 4, line 22, after "path" insert --to initially dampen movement of said member in said path--

Column 4, line 23, after "member" delete --to initially...in said path--

Column 4, line 26, change "to" to --of--

Signed and Sealed this

*Fifth* Day of *February 1980*

[SEAL]

*Attest:*

SIDNEY A. DIAMOND

*Attesting Officer*

*Commissioner of Patents and Trademarks*